United States Patent [19]

Kobelt

[11] Patent Number: 4,470,492

[45] Date of Patent: Sep. 11, 1984

[54] SINGLE STATION, SINGLE LEVER CONTROL ASSEMBLY

[76] Inventor: Jacob Kobelt, 6110 Oak St., Vancouver, British Columbia, Canada, V6M 2W2

[21] Appl. No.: 292,708

[22] Filed: Aug. 13, 1981

[51] Int. Cl.[3] ..... B60K 41/02; G05G 11/00; F16D 23/00

[52] U.S. Cl. ..... 192/0.096; 74/480 B; 74/876

[58] Field of Search ..... 74/480 B, 874, 875, 74/876; 192/0.096, 0.098

[56] References Cited

U.S. PATENT DOCUMENTS

| | | | |
|---|---|---|---|
| 3,202,011 | 8/1965 | Kobelt | 74/472 |
| 3,330,390 | 7/1967 | Kobelt | 192/0.096 |
| 3,780,842 | 12/1973 | Whipple et al. | 192/0.096 |
| 4,119,186 | 10/1978 | Choudhury et al. | 192/0.096 |

*Primary Examiner*—Lawrence J. Staab
*Assistant Examiner*—Michael J. Gonet
*Attorney, Agent, or Firm*—Carver & Co.

[57] ABSTRACT

A control assembly particularly for use in marine controls where a single lever thereof actuates a clutch and throttle of a marine power unit. The assembly has a first input shaft rotatable relative to a body thereof, and an extensible and retractable first output structure for controlling a function, e.g. the throttle. The assembly includes a cam mounted on the first input shaft for rotation therewith and a cam follower cooperating with the cam and the first output structure. A lever means cooperates with the body and cam follower so that the first output structure is actuated in an amount dependent on direction and rotation of the input shaft from an initial position thereof. In a preferred embodiment, a second output structure for the clutch is responsive to primary rotation of the input shaft from the initial position thereof and is unresponsive to secondary rotation, and the first output structure is unresponsive to primary rotation of the shaft and is responsive to secondary rotation thereof.

8 Claims, 8 Drawing Figures

SINGLE STATION, SINGLE LEVER CONTROL ASSEMBLY

BACKGROUND OF THE INVENTION

1. Field of the Invention

The invention relates to a control assembly particularly for a single station, single lever control of a marine power unit having a throttle and reversible gearbox controlled by the lever assembly.

2. Prior Art

Single lever control assemblies for controlling concurrently with one manual lever a throttle and a reversible gearbox and clutch assembly of a marine power unit are old. Essentially, the control assembly permits an operator to control a marine power unit from idle to full throttle in either the forward or reverse modes using only a single lever. In some applications, it is also desirable to provide a manual override throttle for actuation of the engine when the gearbox is in neutral, so as to operate auxiliary equipment such as winches or pumps. The normal operation of a single lever control assembly is as follows. From an initial position of the lever in neutral, with the throttle at idle, a primary movement of the lever results in engagement of the forward or reverse gears of the gearbox, without a change in throttle setting, that is the throttle remains at idle so as to prevent damage to the gearbox. When the particular gear is engaged, additional or secondary movement of the lever results in acceleration of the engine from idle to full throttle, with the clutch remaining engaged throughout the full movement.

Various devices have been developed to attain the above functions, for example see devices described in two patents of the present applicant, namely U.S. Pat. No. 3,202,011 issued in 1965 and U.S. Pat. No. 3,330,390 issued in 1967. Each of the devices of these patents performs a generally similar function, although they may have applications in control systems having more than one station, that is a control system wherein the engine and clutch can be controlled from more than one station or location having similar control levers. In each of these structures, and in all of the structures known to the inventor, there is a non-linear relationship between angular rotation of the lever following gear engagement, and acceleration of the engine. That is there is not a simple direct proportional relationship between the rotation of the lever controlling engine rpm following engagement of the gears. This presents difficulties for accurate control of the vessel, and at extreme ends of the range, it can be difficult to select the desired engine rpm. Furthermore, many of the devices are relatively complex with many moving parts, some of which must be accurately manufactured and maintained and this increases the cost of purchasing and servicing such devices. Furthermore, the provision of a manual override control for the throttle for powering auxiliary equipment also increases complexity and, in some instances, there is a possibility of damage to the engine due to the omission or malfunction of an interlock means that could result in engagement of the gearbox when the engine is at a speed other than idle.

SUMMARY OF THE INVENTION

The invention reduces difficulties and disadvantages of the prior art by providing a control assembly for use with a single lever in which rotation of the lever produces an output which is in an amount dependent on direction and rotation of the lever. When used for controlling two outputs, preferably primary rotation of the lever actuates one of the outputs, for example to select a particular gear, whilst the remaining output is unresponsive to primary lever rotation. When the gear is selected, additional or secondary rotation of the lever in the same direction accelerates the engine from idle in an amount proportional to secondary lever rotation, whilst the clutch output is unresponsive to the additional lever rotation to maintain the selected gear.

A control lever assembly according to the invention has a body, first and second input shafts rotatable relative to the body from respective initial positions, and an extensible and retractable first output means cooperating with the body. The assembly includes a cam means cooperating with the first input shaft for rotation about a cam axis in response to first shaft rotation, and a cam follower cooperating with the cam means to be responsive to rotation of the cam means. The assembly also includes a control arm extending from the second input shaft to rotate therewith in response to rotation of the second input shaft, and a control link hinged to the control arm. The assembly also includes a swinging link hinged for rotation relative to the body, and also hinged to the control link at a first lever hinge, the first lever hinge thus being located by, and responsive to, rotation of the second input shaft. The assembly also includes a lever means cooperating with the first output means and being journalled on the first lever hinge so as to be located by, and responsive to, rotation of the second input shaft. The lever means also cooperates with the cam follower so that the first output means is responsive to rotation of the first input shaft from the initial position thereof. The lever means thus cooperates with the second input shaft so that rotation of the second input shaft swings the lever means to actuate the first output means in a manner generally similar to that following rotation of the first input shaft. The assembly also includes interlock means cooperating with the second input shaft and means responsive to the first input shaft to permit rotation of the second input shaft only when the first input shaft is in the initial position thereof.

A detailed disclosure following, related to drawings, describes a preferred embodiment of the invention which is capable of expression in structure other than that particularly described and illustrated.

DETAILED DISCLOSURE

FIGS. 1 through 4

Figure 1:
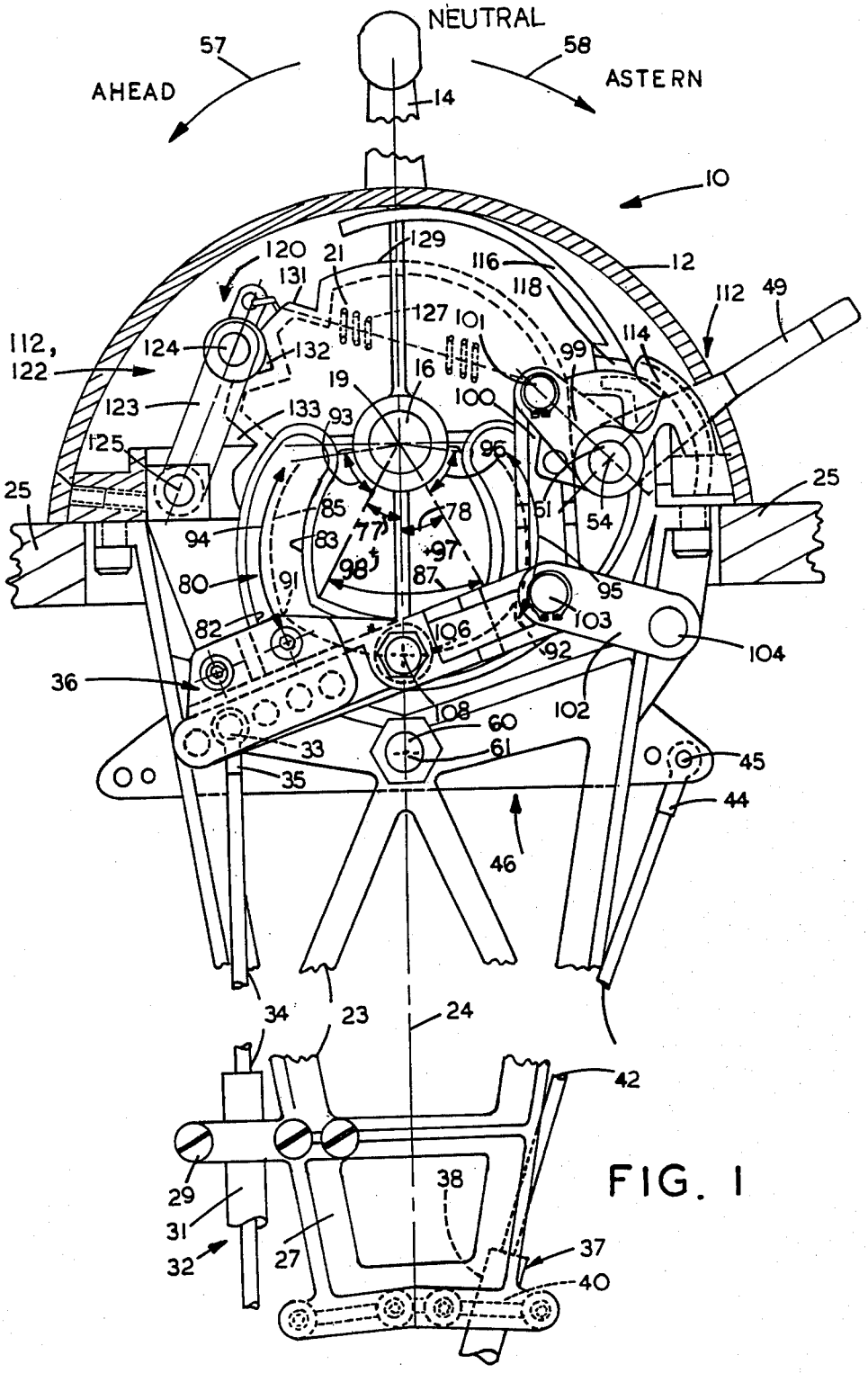
Fig. 1 is a simplified fragmented front elevation of a control assembly according to the invention, a lever thereof shown in a neutral and idle position, some portions omitted for clarity.
Figure 2:
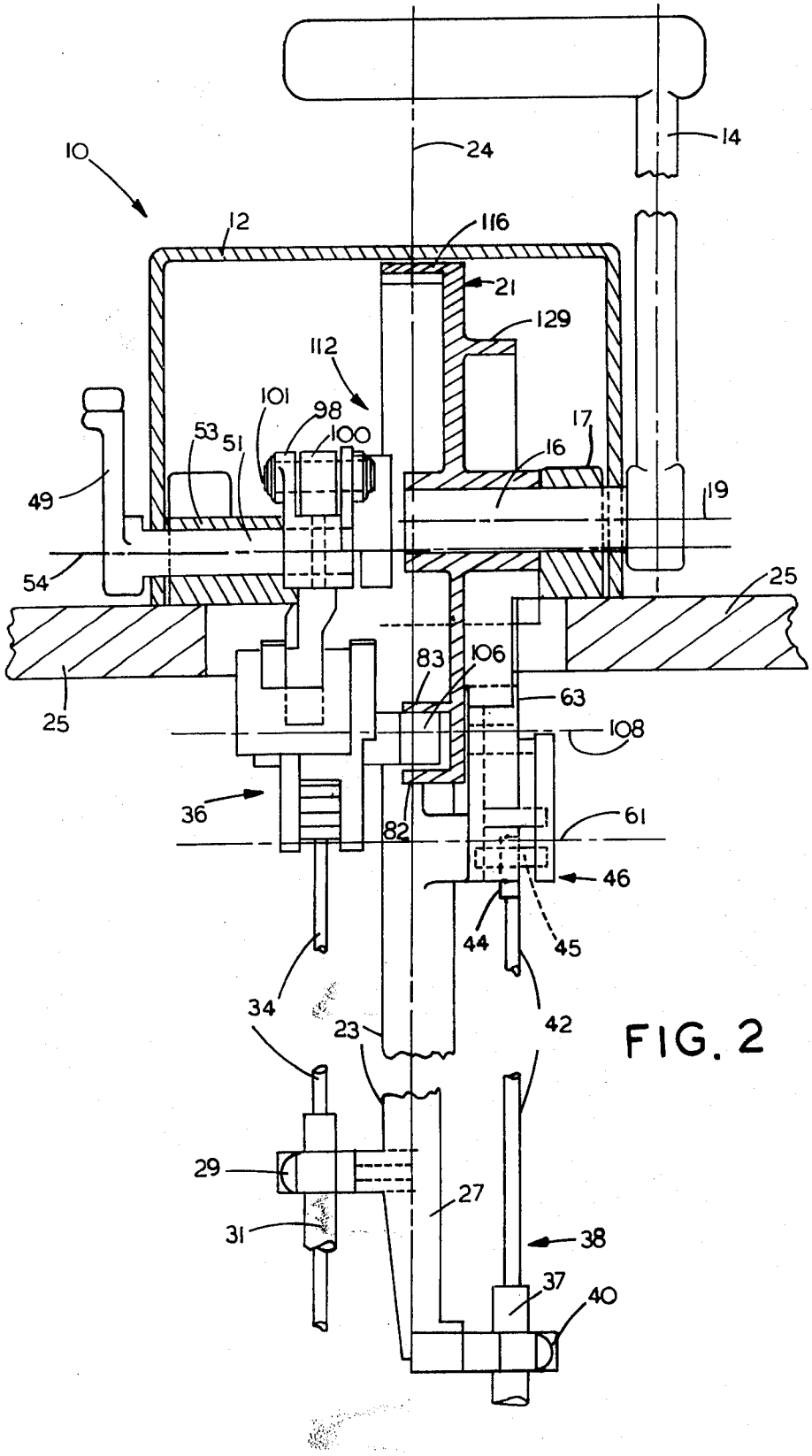
FIG. 2 is a simplified fragmented transverse section of the device, some portions being omitted and some being shown in section.

A control assembly 10 according to the invention has a body 12 and a single manually operable lever 14 mounted on a lever shaft or first input shaft 16. The shaft 16 is carried in a journal 17 and thus is rotatable relative to the body about an axis 19. The shaft 16 carries a main control member 21 thereon so as to be rotatable with the shaft to serve several functions as will be described. The body has a central axis 24 and a cable anchoring frame 23 which is positioned beneath a mounting table 25 to which the body is secured. The cable mounting frame has a lower portion 27 having a cable clamp 29 which secures an outer sheath 31 of a control cable 32 which has a core 34 slidable relative to the sheath. The core 34 has one end having a cable fitting 35 journalled on a pin 33 carried in a throttle output member 36, and has an opposite end extending to a speed control means of a marine engine, not shown, for example the fuel rack of a diesel engine, and thus the cable 32 is termed the throttle control cable. The cable 32 and a similar clutch control cable 37 are preferably push-pull control cables which are capable of transmitting force in either direction, either as a tensile or compressive force. The clutch cable 37 has a sheath 38 connected with a cable clamp 40 to the lower portion 27. The clutch control cable 37 has a core 42 slidable relative to the sheath 38, and has an upper end with a cable fitting 44 mounted on a pin 45 carried in a clutch output member 46, and an opposite end cooperating with a clutch/reversible gearbox assembly, not shown. In FIGS. 1 and 2, the cables and control members are not easily visible in the views as drawn, and are partially omitted or shown in broken outline for simplicity. The cable fittings 35 and 44 serve as extensible and retractable first and second output means producing output signals, via the control cables, to the engine speed control and clutch/gearbox assembly respectively. A manual override throttle lever 49 is mounted on an override shaft or second input shaft 51 journalled for rotation from an initial position thereof in journals 53 about an override input axis 54 and cooperates with the throttle output member 36 as will be described.

Figure 3:
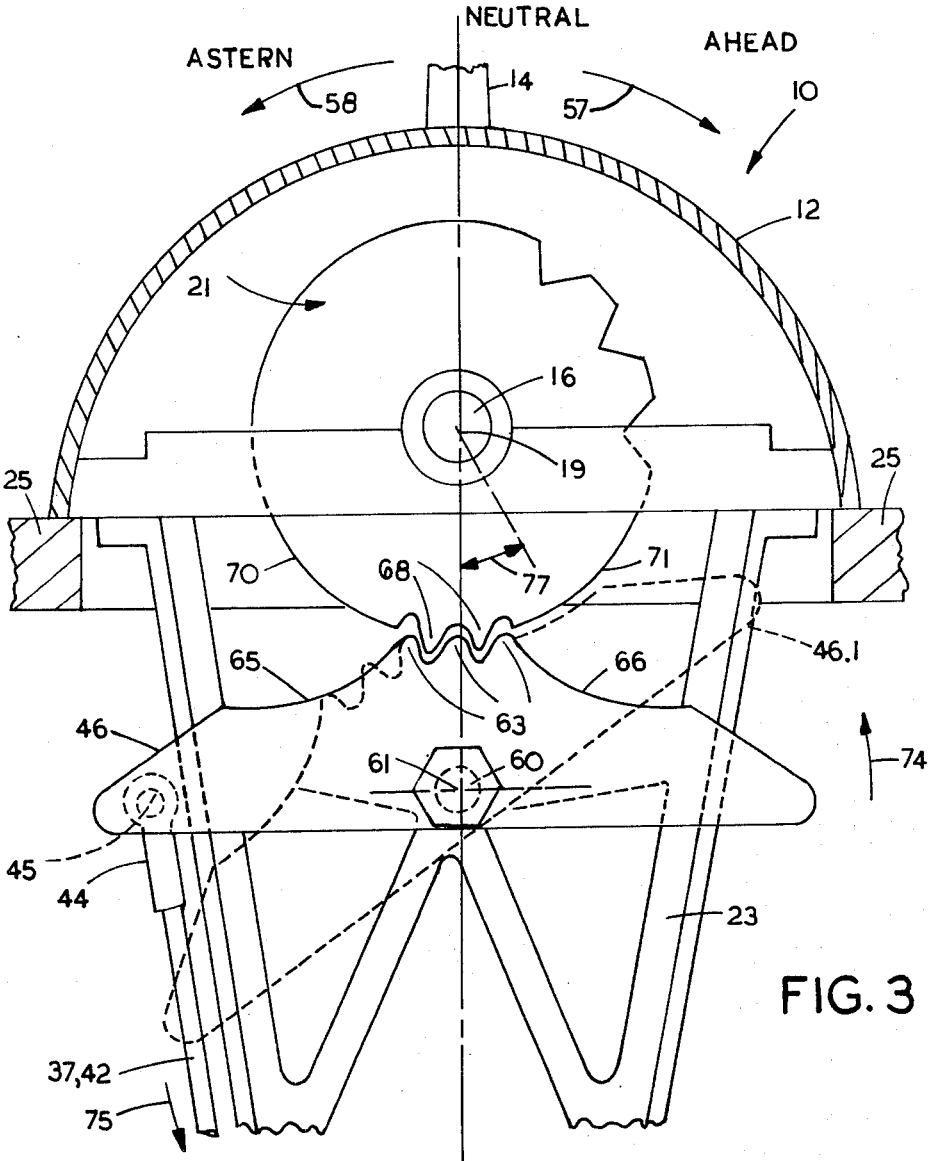
FIG. 3 is a highly simplified and fragmented rear elevation of the device shown in the same position as FIG. 1, with some portions being omitted for clarity.

The lever 14 is shown in the neutral position which is midway between full ahead and full astern positions, arrows 57 and 58 indicating the direction of swinging of the lever to attain ahead and astern gear selections. In the neutral position, the engine is at idle, and, as with many single lever controls, initial movement of the lever results in selection of ahead or astern gear with no change in throttle position, that is the lever selects the gear whilst the engine remains in idle. This initial gear selection results in a primary rotation of the lever shaft 16 with a corresponding actuation of the clutch output member 46. The member 46 and cooperating structure are known means for effecting gear selection in response to input shaft rotation, and in which subsequent shaft rotation in the same direction produces no further change in the clutch output signal. Referring mainly to FIG. 3, the member 46 is journalled for rotation on a spindle 60 having an axis of rotation 61 so as to permit rocking of the member 46 with corresponding actuation of the cable 37. The member 46 has a plurality of teeth 63 which are sandwiched on opposite sides by concave face portions 65 and 66 respectively. The main control member 21 has generally complementary teeth 68 which are sandwiched on opposite sides by convex face portions 70 and 71 which are arcs concentric with the axis 19 and complementary to the portions 65 and 66, the teeth 63 and 68 being spaced apart by recesses to accept the opposing teeth on the complementary member. Rotation of the lever 14 in direction of the arrow 57 produces a corresponding rotation of the member 46 in direction of an arrow 74 to attain the broken outline position 46.1 in which the face portions 66 and 71 are closely adjacent each other and additional rotation of the member 21 produces no further rotation of the member 46. The rotation of the member 46 produces axial movement in direction of an arrow 75 of the core 42 of the cable 37, engaging the clutch in forward gear. In FIG. 1, the shaft is rotated through a minimum angle 77, approximately 30°, to attain the position in which forward gear is fully engaged, the angular rotation being termed primary rotation of the input shaft 16. Similarly, rotation of the lever 14 in an opposite direction, i.e. in accordance with the arrow 58, to attain reverse gear results in a corresponding rotation of the member 46 in an opposite direction through an equal angle 78 witha a corresponding opposite axial movement of the cable core 42. As stated previously, the cooperating teeth and associated structure of the members 21 and 46 are old and equivalent gear and clutch actuating means can be substituted.

Figure 4:
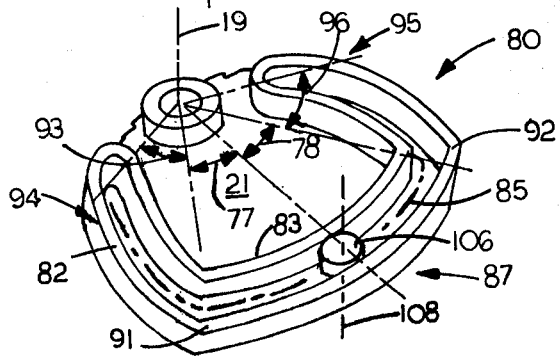
FIG. 4 is a simplified, exaggerated, fragmented perspective of a cam and cam follower of the assembly, shown in neutral.

Referring to FIGS. 1 and 4, the main control member 21 carries a cam track 80 which is a groove having raised side walls 82 and 83 spaced apart at equal distances from a cam groove axis 85. The cam track has a primary portion 87 which is a circular arc centered on the axis 19 which is defined as the cam axis. The complete primary portion extends over an arc of about 60°, defined by the sum of the equal angles 77 and 78, and terminates at cam transition points 91 and 92, indicated in FIG. 1 on the groove axis 85. The cam track also includes two secondary portions 94 and 95 spaced equally on opposite sides of the primary portion 87 and extending from the respective transition points as continuous curves to respective closed outer ends disposed at angles 93 and 96 respectively to the cam transition points 91 and 92. The angles 93 and 96 are less than 60° to provide a full range of movement of the lever 14 of somewhat less than 180°. Portions of the cam groove axis 85 included within the two secondary portions 94 and 95 can be defined as portions of circular arcs having centers located approximately at 97 and 98 respectively which are spaced equally on opposite sides of the central axis 24 of the frame 23. Thus the groove axis 85 is a combination of three smoothly interconnected circular arcs spaced symmetrically about the axis 24.

The override input shaft 51 carries a control arm 99 extending therefrom to rotate in response to rotation of the input shaft 51. A control link 100 is journalled on a hinge pin 101 at one end of the control arm 99 and carries a hinge pin 103 at an opposite end. The throttle output member 36 carries the hinge pin 103 at an end remote from the cable fitting 35 and also carries a cam follower 106 adjacent an intermediate portion thereof between the pin 103 and the cable fitting 35. A swinging link 102 is hinged at an inner end with the pin 103 to the member 36 and the link 102 is hinged at an outer end on a hinge pin 104 mounted in the body 12. As best seen in FIGS. 1 and 4, the cam follower 106 is a journalled cylindrical sleeve mounted for rotation about a cam follower axis 108 and having a diameter to be accepted between the side walls 82 and 83 of the cam track 80 so as to roll therebetween in response to cam track rotation.

It can be seen that the control arm 98, the links 100 and 102 and a portion of the body serve as a four bar mechanism and when the pin 101 is held stationary due to non-rotation of the override input shaft 51, the hinge pin 103 is similarly stationary. Thus, when the shaft 51 is stationary, rotation of the main control member 21 moves the cam track 80 relative to the cam follower, causing the cam follower to swing about the pin 103. Clearly, any movement of the cam follower is magnified at the cable fitting 35 due to the leverage effect of the spacing between the cable fitting 35, the cam follower 106 and the hinge pin 103, which pin serves as a fixed fulcrum. The cam follower cooperates with the cam track and the first output means, and the particular action of the cam follower will be described with reference to FIGS. 5 through 7, as well as actuation of the manual override lever 49 and its effect on the cable fitting 35 which is described with reference to FIG. 8.

In summary, it can be seen that the cam track serves as a cam means, mounted on, or at least cooperating with, the first input shaft for rotation about the cam axis in response to input shaft rotation. The cam means has a primary portion, and at least one secondary portion which is essentially continuous with the primary portion at the cam transition point. The rotation of the first input shaft 16 is divided into primary and secondary rotations which correspond to the position of the cam follower on the respective portions of the cam track. Thus, the cam follower cooperates with the primary and secondary portions of the cam means during primary and secondary rotations respectively of the first input shaft. It can be seen that the throttle output member 36 is in fact a lever means which cooperates with the cam follower and is journalled on a first lever hinge, that is the hinge pin 103, having a first hinge axis that can be held stationary at least temporarily relative to the body. The member 36 is also journalled on a second lever hinge adjacent the cam follower having a second hinge axis, namely the cam follower axis 108. It can be seen that the control link 100 is hinged to the first hinge axis and to the control arm, and the swinging link 102 is hinged to the body and to the first lever hinge so as to locate the first hinge axis with the second input shaft 51 when the shaft 51 is fixed.

It is essential that the manual override throttle lever 49 is actuated only when the gearbox is in neutral, because the override lever is usually used to control auxiliary equipment which is operated only when the gearbox is in neutral and the vessel is stationary. This is effected by an interlock means 112 which permits rotation of the second input shaft 51 only when the first input shaft 16 is in neutral, that is in the initial position. The interlock means includes an arcuate first interlock member 114 fitted on the manual override lever 49 and being an arc of a circle centered on the override input shaft 51. The override means also includes a second interlock member, namely a portion of a curved rim 116 of the main control member 21 which is provided with a clearance 118 sufficient to accept the first interlock arcuate member 114 passing therethrough when correctly aligned. The rim 116 extends approximately equally on either side of the clearance 118 sufficiently to prevent movement of the override throttle lever 49 for any position of the lever apart from idle, i.e. for any position up to full throttle in either astern or ahead positions. The rim thus extends approximately one-half of a revolution which is to accomodate full swinging of the lever 14. Thus, when the member 21 is in the neutral position, as drawn, the clearance 118 is aligned with the arcuate member 114 which can swing thereinto as will be described with reference to FIG. 8, thus preventing movement of the first input shaft when the second input shaft moves from the initial position thereof. In summary, the interlock means has a first interlock member rotatable with the second input shaft, and the cam means has a second interlock member mounted thereon for rotation with the cam. The cam means is located relative to the cam axis so that when the first input shaft 16 is located in the initial position thereof, i.e. at neutral and idle, the first and second interlock means cooperate to permit rotation of the second input shaft 51. Corresponding movement of the throttle output member 36 will be described also with reference to FIG. 8.

The main control member 21 has an indexing means 120 which includes an indexing member 122 which has an arm 123 carrying a roller 124 at an outer end thereof and is hinged on a pin 125 at an inner end thereof. A tension coil spring 127, broken outline, extends from the arm 123 to the body 12 to draw the roller against a cylindrical outer periphery 129 of the main control member 21. The periphery 129 has indentations or index locations 131, 132 and 133 which provide locations for ahead gear engaged, neutral and reverse gear engaged positions respectively, the indentations providing a "feel" for the operator to indicate the particular location of the lever. The indentations 131 and 133 are positioned on the periphery 129 so that when one indentation is engaged by the roller 124 the cam follower 106 is at the cam transition point 91 or 92 respectively. When the cam follower is at either of the cam transition points indicating gear engaged, or between these points, the engine is still at idle. Rotation of the shaft 16 beyond the cam transition points causes the roller to run on portions of the periphery 129 spaced on opposite sides of the three indentations, and this does not require any further indentations to indicate throttle positions up to full throttle. It can be seen that the cam means has the indexing means 120 thereon having first, second and third index locations 132, 131 and 133, the first index location 132 representing initial position of the cam, and the second and third index locations 131 and 133 representing outer limits of the primary portions of the cam spaced on opposite sides of the initial position. The indexing member 122 is complementary to the indexing means 120 of the cam to cooperate with the indexing means to provide a feel for the operator to locate the cam input shaft in the initial position or at the cam transition point between the primary and secondary portions of the cam.

OPERATION

FIGS. 5 through 8

Figure 5:
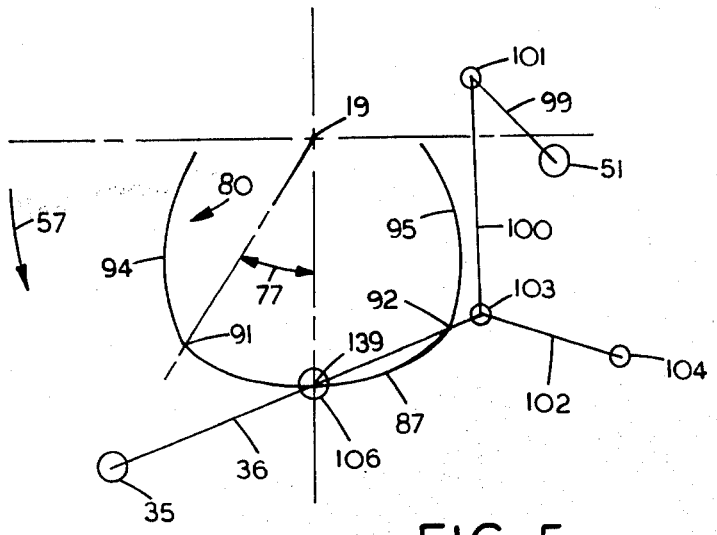
FIG. 5 is a simplified diagram showing major portions of the device in the idle and neutral position as shown in FIG. 1.

FIG. 5 is basically a schematic representation showing relative positions of the major throttle control components in the neutral and idle positions. It can be seen that the cam follower 106 is at a mid position 139 of the cam track 80, and thus is halfway between the transition points 91 and 92 on the primary portion 87. The override input shaft 51, the control arm 99, and the links 100 and 102 locate the hinge pin 103 in a fixed position, thus controlling one end of the throttle output member 36.

Figure 6:
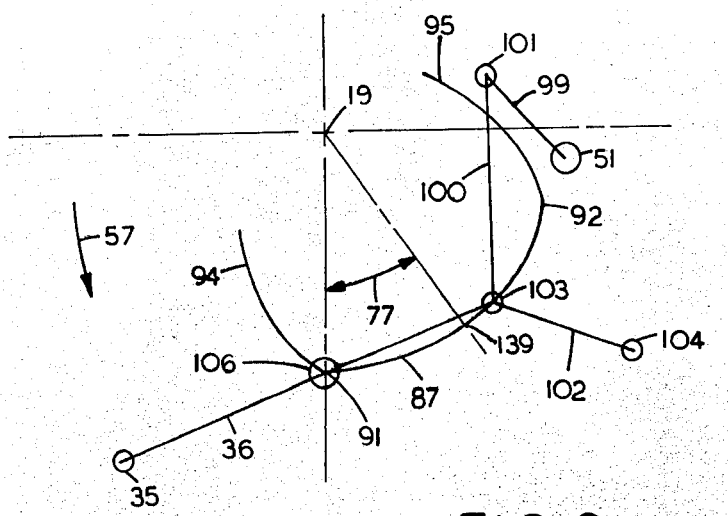
FIG. 6 is a simplified diagram similar to FIG. 5 but with the device shown in an idle position with the forward gear thereof engaged.

Rotation of the cam track 80 in direction of the arrow 57 from the FIG. 5 position through the angle 77 causes the one-half of the primary portion 87 of the cam track to move passed the cam follower 106 until the cam follower attains the transition point 91. This position is shown in FIG. 6 and, because the portion 87 is a circular arc centered on the axis 19, there is essentially no radial movement of the cam follower 106. Because the override input shaft 51 remains stationary during this rotation due to the interlock means, the cable fitting 35 also remains stationary during this primary rotation of the input shaft. Thus, finishing in the position as shown in FIG. 6, the throttle output member 36 has remained stationary during the primary rotation, and thus, there is no change in the signal to the throttle which remains at idle.

Figure 7:
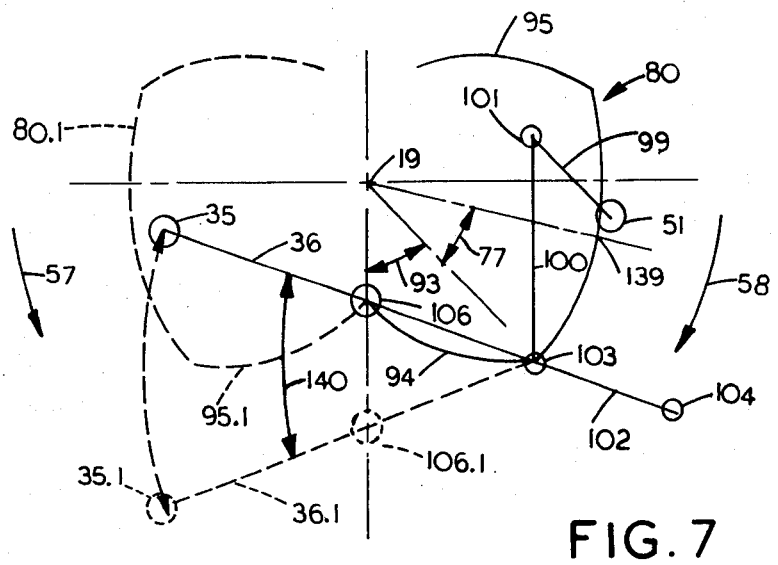
FIG. 7 is a diagram showing the device in the full ahead position.

Referring to FIG. 7, with the secondary input shaft 51 still remaining stationary, the cam track 80 rotates through the complete secondary rotation, i.e. through the additional angle 93 so that the cam follower 106 reaches the outer end of the track. Thus, the secondary portion 94 moves passed the cam follower 106, which is moved upwardly by the groove profile from a broken outline position 106.1 at idle, to a full outline position as shown. This movement causes the throttle output member 36 to swing upwardly through an angle 140 from a broken outline position 36.1, to the full outline position 36, and the cable fitting 35 moves from a broken outline position 35.1 to the full outline position 35 producing a full throttle output signal. Because the pin 103 is still maintained stationary, it provides a fixed fulcrum and a relatively small upwards movement of the cam follower 106 is magnified by the lever effect of the throttle output member, resulting in a considerable movement of the cable fitting 35 which is used to actuate the throttle from idle to full speed. If the rotation of the cam track was reversed from the position shown in FIGS. 5 through 7 and swung through a similar but opposite angle to the end of the secondary rotation, the cam track would assume the broken outline position 80.1. Due to symmetry of the cam track portions 94 and 95, the cam follower 106 would then be in the identical position as before having followed movement along the portion 95, which is shown as 95.1 in broken outline, resulting in the similar full throttle position of the cable fitting at 35. Thus, it can be seen that rotation of the lever shaft 16 in either direction through the complete range of secondary rotation results in a full throttle setting whether the lever 14 is in ahead or in astern position. Therefore each secondary portion of the cam track is a curve having inner and outer portions spaced from the cam axis reflecting initial and extreme output signals of the first output means, the secondary portion of the cam track having a curve interconnecting the two portions to produce an output signal which is essentially proportional to the secondary rotation of the first input shaft.

Figure 8:
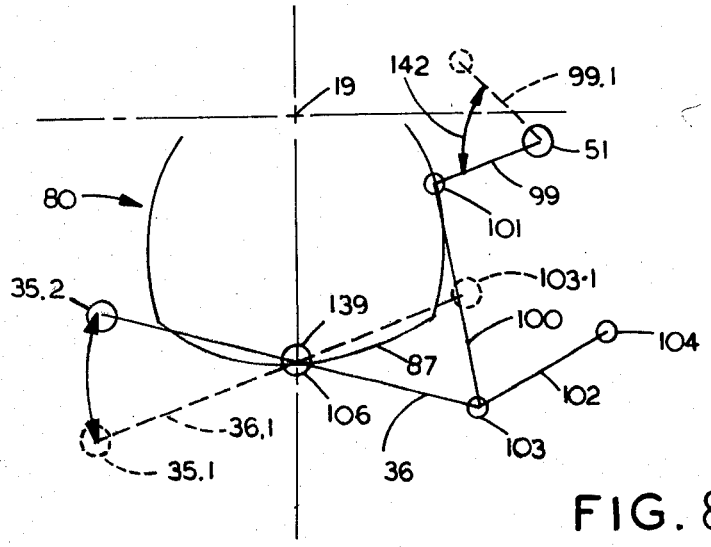
FIG. 8 is a diagram showing the device in neutral with an override throttle thereof in the maximum rpm position.

Referring to FIG. 8, the cam track 80 is shown in the neutral position with the cam follower 106 at the mid position 139 of the primary portion 87. In this position the interlock means 112 (FIG. 1) are aligned which permits the override input shaft 51 to rotate through an angle 142 so that the arm 99 moves from an initial broken outline position 99.1 to a full outline position 99. The pin 101 thus moves downwardly, concurrently moving the control link 100 which is constrained to rotate about the hinge pinn 104 due to the swinging link 102. This moves the hinge pin 103 from an initial broken outline position 103.1 to a lower position which concurrently rotates the throttle output member 36 in direction of an arrow 144 rocking as a teeter-totter about the cam follower 106 from a broken outline position 36.1. This swings the cable fitting 35 to a raised position 35.2 which, as can be seen, changes the throttle output signal from idle, at position 35.1 in broken outline, towards full throttle, although it does not attain the extreme position shown in FIG. 7, and thus full throttle is not attained. Usually full throttle is not required for auxiliary equipment, and thus this is acceptable for most applications. With the cam profiles as drawn, the cam follower 106 moves a small amount and this is not a true fixed fulcrum for the member 36, but this small amount of movement is immaterial. Thus, the lever means is journalled on the first lever hinge which cooperates with the control arm to be responsive to rotation of the second input shaft. With this arrangement, the first hinge axis of the first lever hinge is stationary when the second input shaft is stationary and, when the first input shaft is in the initial position thereof, rotation of the second input shaft moves the first hinge axis so as to swing the lever means to actuate the first output means.

In summary, it can be seen that the override input shaft 51 is a second input shaft journalled for rotation relative to the body, and having an interlock means to permit rotation of the second input shaft only when the first input shaft is in the initial position, so that rotation of the second input shaft actuates the first output means in a manner generally similar to that following rotation of the first input shaft. In effect, the control link and swinging link cooperate with the throttle output member 36 to control movement of the first lever hinge and thus the member 36 in response to rotation of the second input shaft.

ALTERNATIVES AND EQUIVALENTS

The assembly is described for use as a single lever combined throttle and reversible clutch control, with an optional override throttle control. The throttle and clutch controls can be considered as the first and second output means. In the two output embodiments as shown, the input shaft is subjected to primary and secondary rotations and the lever means cooperates with the cam follower so that during the primary rotation of the input shaft there is essentially no change in the first output means. Then, during secondary rotation of the input shaft, the first output means is actuated an amount proportional to the rotation of the input shaft from the cam transition point. The second output means cooperates with the input shaft and is responsive to the primary rotation of the input shaft from the initial position, but is unresponsive to the secondary rotation of the input shaft after the cam follower passes the cam transition point.

In contrast with prior art devices known to the inventor using pinned links, there is a considerable degree of design choice when devising the cam profile. If desired, the primary portion could be slightly non-circular adjacent the cam transition point so as to increase engine rpm slightly immediately prior to gear engagement and then to return to idle. This slight rpm increase reduces chances of the engine stalling during gear engagement. Also, the geometry of the secondary portions of the cam track can be selected to provide a desired proportionality relationship between rotation of the lever 14 from idle at the beginning of the secondary rotation, to full throttle at the end of the secondary rotation. It is preferred to make this cam portion an essentially linear relationship by selecting the circular arcs as shown, but clearly other relationships can be attained by changing the curve geometry between the ends of the secondary portions.

If desired, in an alternative the second output means also can be eliminated and the cam can be designed for one type of rotation only, in which the cam means would have a cam track spaced at a radial distance from the cam axis which varies from the initial position to an extreme outer position. Thus in the alternative the lever means cooperates with the body and the cam follower so that the first output means is actuated in an amount dependent on direction and amount of rotation fo the input shaft from an initial position thereof. This is a simpler alternative arrangement than that illustrated and clearly would have an alternative application. /

I claim:

1. A control lever assembly having a body, first and second input shafts rotatable relative to the body from respective initial positions, and an extensible and retractable first output means cooperating with the body, the assembly including:

(a) a cam means cooperating with the first input shaft for rotation about a cam axis in response to first shaft rotation, and a cam follower cooperating with the cam means to be responsive to rotation of the cam means, (b) a control arm extending from the second input shaft to rotate therewith in response to rotation of the second input shaft, and a control link hinged to the control arm, (c) a swinging link hinged for rotation relative to the body, and also hinged to the control link at a first lever hinge, the first lever hinge thus being located by, and responsive to, rotation of the second input shaft, (d) a lever means cooperating with the first output means and being journalled on the first lever hinge so as to be located by, and responsive to, rotation of the second input shaft, the lever means also cooperating with the cam follower so that the first output means is responsive to rotation of the first input shaft from the initial position thereof, the lever means thus cooperating with the second input shaft so that rotation of the second input shaft swings the lever means to actuate the first output means in a manner generally similar to that following rotation of the first input shaft, (e) interlock means cooperating with the second input shaft and means responsive to the first input shaft to permit rotation of the second shaft only when the first input shaft is in the initial position thereof.

2. A control assembly as claimed in claim 1 in which:

(a) the cam means has a primary portion and at least one secondary portion which is essentially continuous with the primary portion at a cam transition point, (b) the cam follower cooperates with the primary and secondary portions of the cam means during primary and secondary rotations respectively of the first input shaft, (c) the lever means cooperates with the cam follower so that during the primary rotation of the first input shaft there is essentially no change in the first output means, and during secondary rotation of the first input shaft the first output means is actuated an amount proportional to the rotation of the first input shaft from the cam transition point.

3. A control assembly as claimed in claim 2 further including:

(a) a second output means cooperating with the input shaft and responsive to the primary rotation of the input shaft from the initial position, but unresponsive to the secondary rotation of the input shaft after the cam follower passes the cam transition point.

4. A control assembly as claimed in claim 2 in which:

(a) the primary portion of the cam track is a circular arc centered on the cam axis, (b) the secondary portion of the cam track is a curve having inner and outer portions spaced from the cam axis reflecting initial and extreme output signals of the first output means, the secondary portion of the cam track having a curve interconnecting the two portions to produce an output signal which is essentially proportional to the secondary rotation of the first input shaft.

5. A control assembly as claimed in Claim 2 in which:

(a) the cam means has an indexing means thereon having first, second and third index locations, the first index location representing the initial position of the cam means, and the second and third index locations representing outer limits of the primary portions of the cam means spaced on opposite sides of the initial position, (b) an indexing member complementary to the index locations of the cam means to cooperate with the indexing means to provide a feel for the operator to locate the cam input shaft in the initial position or at the cam transition points between the primary and secondary portions of the cam means.

6. A control assembly as claimed in claim 1 in which:

(a) the cam means has a cam track spaced at a radial distance from the cam axis which varies from the initial position to an extreme outer position, (b) the lever means is journalled on the first lever hinge which has a first hinge axis that can be held stationary at least temporarily relative to the body, and on a second lever hinge generally adjacent the cam follower.

7. A control assembly as claimed in claim 1 in which the interlock means is characterized by:

(a) the second input shaft having a first interlock member rotatable therewith, (b) the cam means having a second interlock member mounted thereon for rotation with the cam, and located relative to the cam axis so that when the first input shaft is located in the initial position thereof, the first and second interlock means cooperate to permit rotation of the second input shaft.

8. A control lever assembly as claimed in claim 7 in which:

(a) the first interlock member is an arcuate member which is an arc of a circle centered on and rotatable with the second input shaft, (b) the second interlock member is a portion of a curved rim mounted for rotation with the cam means and having a clearance sufficient to accept the first interlock member passing therethrough when correctly aligned when the cam means is in the initial position thereof, so that movement of the second input shaft is permitted only when the first input shaft is in the initial position thereof.

* * * * *